United States Patent [19]

Trambale

[11] Patent Number: 4,970,501

[45] Date of Patent: Nov. 13, 1990

[54] METHOD FOR WRITING DATA INTO AN IMAGE REPETITION MEMORY OF A DATA DISPLAY TERMINAL

[75] Inventor: Pedro Trambale, Munich, Fed. Rep. of Germany

[73] Assignee: Siemens Aktiengesellschaft, Berlin and Munich, Fed. Rep. of Germany

[21] Appl. No.: 833,420

[22] Filed: Feb. 21, 1986

Related U.S. Application Data

[63] Continuation of Ser. No. 418,437, Sep. 15, 1982, abandoned.

[30] Foreign Application Priority Data

Sep. 30, 1981 [DE] Fed. Rep. of Germany ..... 3138930

[51] Int. Cl.[5] ..... G09G 1/06

[52] U.S. Cl. ..... 340/750; 340/798; 340/799

[58] Field of Search ..... 340/750, 798, 799

[56] References Cited

U.S. PATENT DOCUMENTS 4,117,469 9/1978 Levine ..... 340/750

4,146,877 3/1979 Zimmer ..... 340/750

4,177,462 12/1979 Chung ..... 340/750

FOREIGN PATENT DOCUMENTS 3026225 2/1982 Fed. Rep. of Germany .

*Primary Examiner*—Alvin F. Oberley

*Assistant Examiner*—Richard Hjerpe

*Attorney, Agent, or Firm*—Hill, Van Santen, Steadman & Simpson

[57] ABSTRACT

With a data display terminal having an electron beam tube, an image repetition memory serves for cyclically regenerating the display. With a change of the display, a complete overwriting can be necessary. However, the overwriting of the image repetition memory cannot interrupt the regeneration operation. The beam flyback times during an image cycle do not suffice in order to overwrite the entire image repetition memory. Therefore, data are written into the image repetition memory during a forward line scan and are simultaneously written into a line buffer designed as a clock interface. With this technique, an entire image repetition memory can be written during an image cycle.

1 Claim, 3 Drawing Sheets

FIG 4

| | 15 | | 3 | | 6 | | 16 | 17 | 18 | | 11'' |
|---|---|---|---|---|---|---|---|---|---|---|---|
| A | 1<br>2<br>3 | 0<br>0<br>1 | $\overline{RD}$<br>$\overline{WR}$ | X<br>X | $\overline{WR}$ | ⊔ | 0 | 0 | $\overline{RD}$<br>$\overline{WR}$ | X<br>X | ⊔ |
| B | 1<br>2<br>3 | 0<br>1<br>0 | $\overline{RD}$<br>$\overline{WR}$ | ⊔<br>⊔ | $\overline{WR}$ | ⊔ | 1 | 1 | $\overline{RD}$<br>$\overline{WR}$ | ⊔<br>⊔ | X |
| C | 1<br>2<br>3 | 1<br>0<br>0 | $\overline{RD}$<br>$\overline{WR}$ | X<br>⊔ | $\overline{WR}$ | ⊔ | 0 | 0 | $\overline{RD}$<br>$\overline{WR}$ | X<br>X | ⊔ |

METHOD FOR WRITING DATA INTO AN IMAGE REPETITION MEMORY OF A DATA DISPLAY TERMINAL

This is a continuation, of application Ser. No. 418,437, filed Sept. 15, 1982, now abandoned.

BACKGROUND OF THE INVENTION

1. Field of the Invention

The present invention relates to a method for writing data into an image repetition memory of a data display terminal under the control of a memory access control, the data display terminal exhibiting an electron beam tube and an image control unit having at least two line buffers designed as clock interfaces.

2. Description of the Prior Art

Given a data display terminal which comprises an electron beam tube, refreshing the representation with, for example, approximately 50 Hz is required for a flicker-free presentation. The data to be displayed must be deposited in an intermediate memory, from which the data must always be called in the rhythm of the image repetition. Such an intermediate memory is called an image repetition memory.

The image repetition memory must, on the one hand, be available to the display terminal for the regeneration operation, but the image repetition memory must also be able to accept external data, for example from a data memory, when the image on the picture screen is to be altered. If the regeneration operation is not to be interrupted given a change of picture, then the inscription of new data must be chronologically interleaved with the read-out of the data for the image regeneration.

Such an interleaving can occur, for example, in such a manner that the image repetition memory is read during a forward beam scan, whereas the overwriting of the image repetition memory occurs during the beam flyback. As is known, the beam flyback time is shorter than the forward beam scanning time. Therefore, the sum of all forward beam scan times during an image cycle is significantly smaller than the sum of all beam flyback times.

Particularly given display terminals with a high character and line plurality or given display terminals in which additional control data are read into the image repetition memory with each datum to be displayed, the available beam flyback times during an image cycle can be insufficient for overwriting a memory area or for overwriting the overall memory area. Therefore, the overwriting must occur in a plurality of image cycles. For this purpose, a new image can only be slowly constructed. In addition to the loss of time, the slow image construction can have a disruptive effect on an operator.

A data display terminal is known from the German published application 30 26 225, fully incorporated herein by this reference, in which the characters to be displayed are the image repetition memory. The characters are supplied by way of two buffers of an image control unit, the buffers being designed as clock interface devices. Thereby, respectively one of the buffers can be connected to the background memory and the other can be connected to the image control unit. The image control unit controls the two buffers in such a manner that, simultaneously with the display content of the one buffer on the picture screen, the other buffer is loaded by the background memory with the characters to be subsequently displayed.

SUMMARY OF THE INVENTION

It is therefore the object of the present invention to provide a method of the type generally set forth above with which the overwriting of the image repetition memory occurs within one image cycle.

The above object is achieved in that, at the beginning of all forward line scans, the image control unit forwards a request signal to the memory access control, in that, subsequently, a signal for writing data is forwarded to the image repetition memory and to the line buffer, in that, during the forward line scan, data are simultaneously written into the image repetition memory and one of the line buffers, and in that the image control unit emits a synchronizing signal at the end of an image cycle which terminates the inscription of the data.

The data word to be written into the image repetition memory, therefore, is simultaneously written into one of the line buffers. Since the write operation occurs during the forward beam scan, the beam flyback times are available for further writing operations. For example, further control data can be read in. Therefore, a larger plurality of control functions can be executed at the data display terminal. The ease of operation and the range of employment of the data visual display are enlarged.

BRIEF DESCRIPTION OF THE DRAWINGS

Other objects, features and advantages of the invention its organization, construction and operation will be best understood from the following detailed description, taken in conjunction with the accompanying drawings, on which:

FIG. 4 is a tabular representation of control signals which may be employed in practicing the present invention.

DESCRIPTION OF THE PREFERRED EMBODIMENTS

Figure 1:
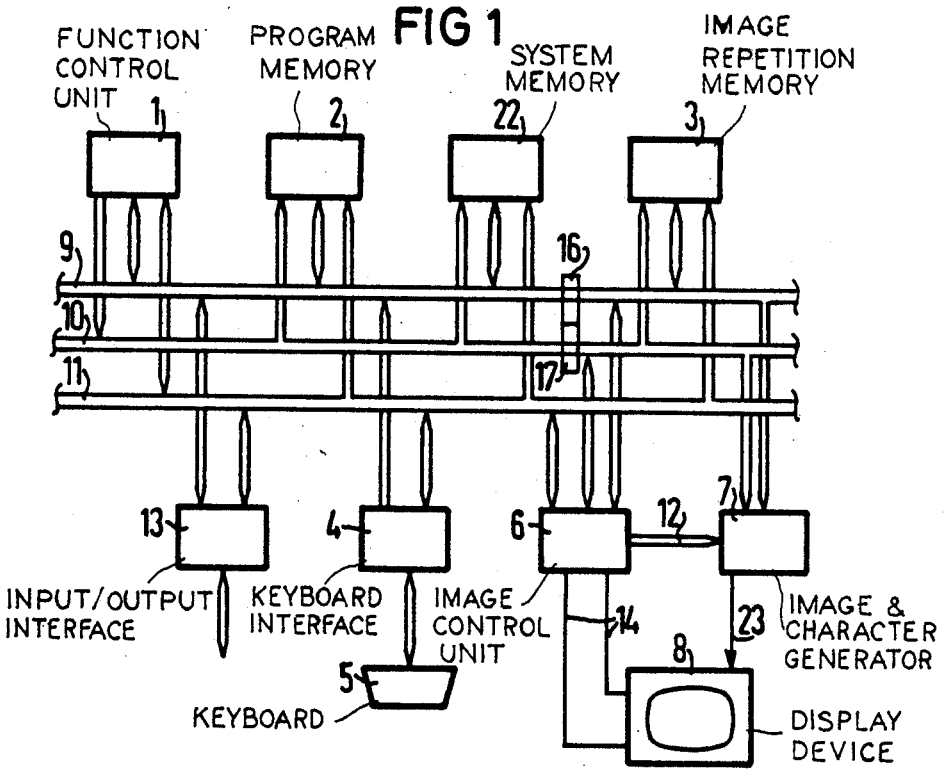
FIG. 1 is a block diagram illustrating units of a known data display terminal.

Referring to FIG. 1, the data display terminal illustrated thereon comprises a display device 8 for representing characters. The display device 8 is provided with a cathode ray tube having a picture screen, as well as with deflection amplifiers and a circuit portion which modulates the intensity of the electron beam at the picture screen, as is well known in the art. Further, the display terminal also comprises an image control unit 6 and an image and character generator 7 for generating the character shapes and for formatting the image on the picture screen. A data memory having random access serves as the image repetition memory 3. An input/output interface 13 is provided for inputting and outputting external data, for example from a computer. Data can be input over a keyboard interface 4 from a keyboard 5. Moreover, the data display terminal comprises a function control unit 1 and a system memory 22 having random access. Data for control of the function control unit 1 are stored in a program memory 2. The function control unit 1 can be designed, for example, as a microprocessor. Not illustrated is a first memory access control with which a direct memory access to the system memory 22 can be controlled. A system clock determines the speed of the data transmission given memory access.

Data lines which are referred to as a data bus 9 are provided for the transmission of data. The addressing of the individual units occurs by way of address lines which are referred to as an address bus 10. The data bus 9 and the address bus 10 can exhibit, for example, 16 lines each. The drive of the units, for example for the selection of the function "write" or respectively, "read", occurs by way of control lines referred to as a control bus 11. Transmission over the data, address and control lines can be bidirectional. They are respectively connected to the function control unit 1, to the program memory 2, to the system memory 22, to the image repetition memory 3, to the input/output interface 13, to the keyboard interface 4, to the picture control unit 6, and the character generator 7 and the first memory access control.

The image control unit 6 is connected via video address lines 12 to the character generator 7. The image and character generator 7 is also connected to the display device by way of a video data line 23. In addition, the image control unit 6 is connected via two synchronizing lines 14 to the display unit 8. The data transmission from the image control unit 6 to the character generator 7 occurs with a clock determined by the display unit 8.

Since, given an electron beam tube, the data on the picture screen remain visible only for a limited time, they must be refreshed at regular intervals. All data to be displayed are stored in the image repetition memory 3. When the display on the picture screen is not to be changed, the image repetition memory 3, the image control unit 6, and the character generator 7 can be uncoupled from the function control unit 1 by way of a pair of switches 16 and 17 in the data address buses 9 and 10. The regeneration operation then occurs under the control of the image control unit 6.

When a change of picture is to occur, then the lines separated by the switches 16 and 17 are connected. Under the control of the function control unit 1 or, respectively, of the first memory access control, new, external data are written into the image repetition memory 3. These external data can, for example, derive from the system memory 22, from the input interface 13, or from the keyboard interface 4.

Figure 2:
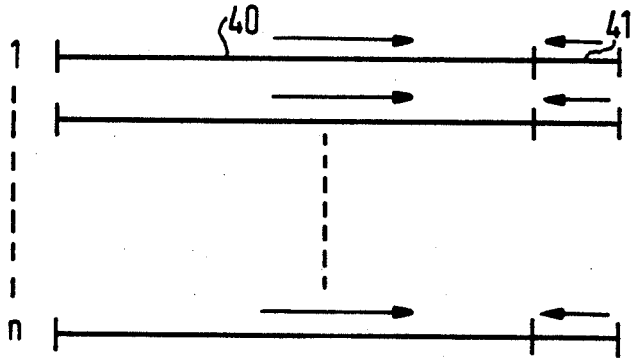
FIG. 2 schematically illustrates the transit times of an electron beam of a data display terminal.

FIG. 2 illustrates the transit times of the electron beam during an image cycle. During the image cycle, the picture screen is written, for example, in n lines, whereby the image repetition memory is read out once. During the forward beam scan 40, the characters to be displayed are written on the picture screen. During the beam flyback time 41, the electron beam skips to the top of the screen without writing, for example to a new line beginning or from the last line to the image beginning. The sum of all beam flyback times 41 of an image cycle is significantly shorter than the sum of the forward beam scan times 40, so that the image return times available during an image cycle do not suffice for overwriting the entire image repetition memory.

Figure 3:
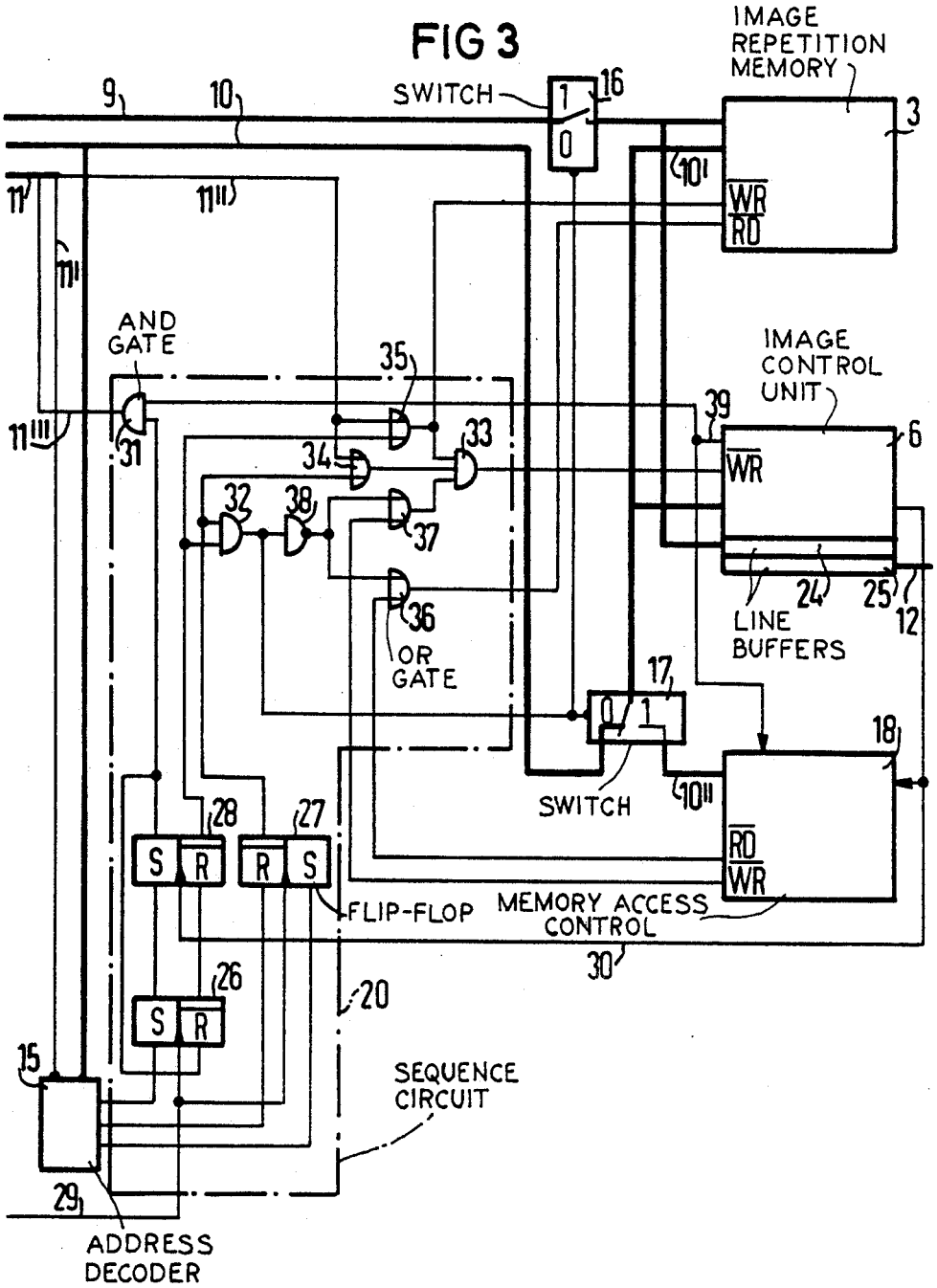
FIG. 3 is a schematic representation of a circuit arrangement for executing the method of the present invention.

FIG. 3 illustrates the image repetition memory 3, the image control unit 6 having a first line buffer 24 and a second line buffer 25, and a second memory access control 18 for the image repetition memory 3. The data bus 9 is connected over a controllable switch 16 to the image repetition memory 3 and to the first line buffer 24. The address bus 10 is connected over a controllable selective switch 17 to the image repetition memory 3 and to the image control unit 6. The selective switch 17 alternately connects the address lines 10' leading from the image repetition memory 3 to the image control unit 6 to the address bus 10 or, respectively, to the address lines 10'' which lead to the second memory access control 18. The address bus 10, moreover, is connected to an address decoder 15. The control lines 11 are subdivided into a first control line 11', a second control line 11'', and a third control line 11'''. The first control line 11' is connected to the address decoder 15. The second control line 11'' is connected to a sequence circuit 20. The third control line 11''' leads from the sequence circuit 20 to the first memory access control. The circuit arrangement illustrated in FIG. 2 operates in three different operating modes A, B and C. In the first operating mode A, the function control unit 1 controls all operations necessary for placing the data display terminal in operation. Included therein, for example, are the loading of parameters for the display format into the image control unit 6. The switch 16 is closed for this purpose. Moreover, the address lines 10' are connected over the selective switch 17 to the address bus 10, i.e. the second memory access control 18 is uncoupled from the image repetition memory 6.

In the second operating mode B, the picture screen control unit 6 controls the read-out of the image repetition memory 3, whereby the second memory access control 18 emits the required addresses to the address lines 10' The switch 16 is open and the address lines 10'' are connected over the selective switch 17 to the address lines 10'

In the third operating mode C, the image repetition memory 3 is overwritten with external data under the control of the first memory access control. At the same time, the word to be written into the image repetition memory 3 is written into the line buffer 24. Thereby, the switch 16 is closed and the selective switch 17 connects the address lines 10' to the data bus 10. The two line buffers 24 and 25 serve as a clock interface. Writing into the line buffer 24 is carried out with the system clock. The line buffer 25 is read with the clock of the display unit 8 over the video data lines 12. It is significant that the overwriting of the image repetition memory 3 occurs during the forward line scan of the electron beam.

The three operating modes A, B and C are determined by the three states of the sequence circuit 20. The sequence circuit 20 is controlled over three outputs of the decoder 15 which are referenced 01–03. Over the lines 29 and 30, it is synchronized with the system clock and a synchronizing clock of the display unit 8. A change of the output signals of the sequence circuit 20 respectively occurs given a system clock and/or given a synchronizing clock.

The sequence circuit 20 comprises three flip-flops (FF) 26, 27 and 28. Moreover, the sequence circuit 20 comprises four OR elements 34, 35, 36 and 37, and two AND elements 31, 33. The image repetition memory comprises an input $\overline{RD}$, which effects the lead-in of data on the data bus 9 as soon as a signal is applied. It further comprises an input $\overline{WR}$which effects the output of data onto the data bus 9 as soon as a signal is applied. The image control unit 6 likewise comprises an input $\overline{WR}$. A signal at this input causes data to be transferred from the data bus 9 into the line buffer 24. The second memory access control 18 comprises an output $\overline{RD}$ and an output $\overline{WR}$. A signal at one of these outputs causes, given direct memory access to the image repetition memory, i.e. given regeneration of an image in the display unit 8, a read or, respectively, write operation of the image repetition memory 3.

The three states are described on the basis of a survey illustrated in FIG. 4. In FIG. 4, "X" means that a potentially occurring signal is non-operative because it is suppressed in the sequential circuit 20. The symbol "⊔" means that a signal is effective and is not suppressed by the sequential circuit.

Every signal on one of the described lines can assume one of the two levels "1" or, respectively "0". The writing into the image repetition memory and the line buffer 24 occurs when a "0" level is applied to the $\overline{WR}$ input. The, reading of the image repetition memory 3 occurs when a "0" level is applied to the $\overline{RD}$ input. The switch 16 is closed when a "0" level is at its control input; it is opened given a "1" level. The switch 17, given a "0" level, connects the address lines 10' to the address bus 10; given a "1" level, it connects the address lines 10' to the address lines 10''. The outputs 01, 02 and 03 of the address decoder 15 exhibit the levels "0, 0, 1" or, respectively "0, 1, 0" or, respectively, "1, 0, 0" given the operating states A, B, C. In the operating state A, the write signal is through-connected from the control lines 11'' over the OR element 34 only to the image control unit 6 whereas it is blocked to the image repetition memory 3 by the OR element 35.

In the operating state B, the read or, respectively, write signal is through-connected from the second memory access control 18 over the OR elements 36 and 37 to the image repetition memory 3 and to the image control unit 6.

In the operating state C, the sequence circuit 20 has the following states. The AND element 31 through-connects a memory access request signal deriving from the image control unit 6 to the first memory access control unit. The OR element 35 and the AND element 33 through-connect a write signal from the control line 11'' to the image repetition memory 3 and to the image control unit 6. The OR elements 36 and 37 respectively block a write or, respectively, read signal coming from the second memory access control 18.

In the following, the method steps which lead to the operating mode C are described by way of example. The address decoder 15 is activated by the function control unit 1 over the line 11'. Subsequently, a data word applied to the address bus 10 is decoded. This data word determines the output level of the address decoder 15. At the next clock signal of the system clock on the line 29, the output levels for the address decoder 15 are taken over by the flip-flops 26 and 27. At the next clock signal of the synchronizing clock, i.e. when an image cycle has been concluded, the output levels of the flip-flop 26 are forwarded by way of the flip-flop 28. Therefore, a "1" level is applied to the AND element 31. Therefore, a line beginning signal is through-connected on the line 39. The line beginning signal occurs at the beginning of the forward line scan of an image cycle. It causes a memory request for a direct memory access to the system memory 22. The first memory access control, in response thereto, emits the first memory address of the image repetition memory onto the address bus 10. As soon as a write signal occurs on the control line 11'', the data word applied on the data bus 9 is written into the first memory location and into the first line buffer 24, whereas the second line buffer 25 is read. At the next line beginning signal, the next memory locations of the image repetition memory 3 are inscribed, whereby the first line buffer 24 is overwritten after its content has been transferred into the second line buffer 25. At the end of the last line, i.e. at the end of the image cycle, therefore, the entire image repetition memory 3 is overwritten. The image control unit then generates a synchronizing signal which clocks the flip-flop 28 so that two levels are applied at its outputs.

The structure of the sequence circuit 20 is described in the following paragraphs. The sequence circuit 20 exhibits two flip-flops 26 and 27 which are clocked via line 29 with the system clock. A third flip-flop 28 is clocked over a line 30 which is connected to the image control unit 6 and to the memory access control 18 and on which the synchronizing clock is applied. The synchronizing clock comprises a signal which is generated after each image cycle.

The first output of the address decoder 15 is connected to the set input S of the flip-flop 26. Each of the other two outputs of the address decoder 15 is connected to the respective inputs R and S of the flip-flop 27. The output of the flip-flop 26 is connected to the set input S of the flip-flop 28 and the complementary output of the flip-flop 26 is connected to the reset input of the flip-flop 28. The non-inverting output of the flip-flop 28 is fed back to the reset input R of the flip-flop 26. The inverting output of the flip-flop 27 is connected to the OR element 34 and to an AND element 32. A line 39 extends from the image control unit 6 to the AND element 31 and to the memory access control 18 and carries a signal which is output when a line of an image cycle is displayed (line beginning signal). This means that an access to the image repetition memory 3 or to the system memory 22 is desired (memory access request signal).

The inputs of the AND element 32 are connected to the outputs of the flip-flops 27 and 28. The output of the AND element 32 is connected to the switch 16, to the selective switch 17, and to an inverter 38. The output of the inverter 38 is connected to the OR elements 36 and 37. The $\overline{RD}$ output of the memory access control 18 is connected to the R element 37. The $\overline{WR}$ output of the memory access control 18 is connected to the OR element 36. The output of the OR element 36 is connected to the $\overline{RD}$ input of the image repetition memory 3. The output of the OR element 37 is connected to the AND element 33. The output of the AND element 33 is connected to the $\overline{WR}$ input of the image control unit 6. The negating output of the flip-flop 28 is connected to the OR element 35. The negating output of the flip-flop 27 is connected to the R element 34. The outputs of the OR elements 34 and 35 are connected to the AND element 33. The control line 11'' is connected to the OR elements 34 and 35. The non-inverting output of the flip-flop 28 and the line 39 are connected to the AND element 31. The output of the AND element 31 is connected to the input of the first memory access control.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A method of operating a data display terminal which comprises an image repetition memory for storing in binary form, characters to be displayed and for receiving and storing data input from an external source via a function control unit, a memory access control connected to the image repetition memory for controlling access thereto, a display device including a picture screen and operable over an image cycle to scan a beam line-by-line across the picture screen during a scan time and return the beam to a line beginning point during a flyback time, an image control unit connected between the image repetition memory and the display device for controlling proper character display on the picture screen, and two line buffers as clock interfaces over which the characters are conducted from the image repetition memory to the image control unit, one of the line buffers accepting all characters of a line to be displayed, whereby one of the line buffers can be connected to the image repetition memory and the other line buffer can be connected to the image control unit, the image control unit operable to control the two line buffers so that, simultaneously with the display of the content of the one line buffer on the picture screen, the other line buffer is loaded by the image repetition memory with the characters to be subsequently displayed, comprising the steps of:

at the beginning of all line scans of an image cycle, transmitting a request signal from the image control unit to the image repetition memory; subsequently, transmitting a data writing signal from the function control unit to the image repetition memory and to one of the line buffers for writing data from an external source; during the beam scan times, writing new data into the image repetition memory and one of the line buffers; and transmitting a synchronizing signal at the end of an image cycle from the image control unit to the function control unit to terminate the writing of data.

* * * * *